United States Patent [19]

Pfalzgraf et al.

[11] Patent Number: 5,035,213

[45] Date of Patent: Jul. 30, 1991

[54] LOAD-SHIFTING DEVICE

[75] Inventors: Manfred Pfalzgraf, Frankfurt am Main; Gerd Hickmann, Schwalbach/Ts.; Eberhard Mausner, Liederbach/Ts., all of Fed. Rep. of Germany

[73] Assignee: VDO Adolf Schindling AG, Frankfurt am Main, Fed. Rep. of Germany

[21] Appl. No.: 455,608

[22] Filed: Dec. 22, 1989

[30] Foreign Application Priority Data

Jan. 20, 1989 [DE] Fed. Rep. of Germany ..... 3901583

[51] Int. Cl.[5] ..... F02D 45/00; F02D 41/02; F02D 41/16

[52] U.S. Cl. ..... 123/336; 123/339; 123/361

[58] Field of Search ..... 123/337, 339, 340, 361, 123/399, 336

[56] References Cited

U.S. PATENT DOCUMENTS

| | | | |
|---|---|---|---|
| 4,827,884 | 5/1989 | Cook | 123/336 |
| 4,848,297 | 7/1989 | Hickmann et al. | 123/361 X |
| 4,892,071 | 1/1990 | Asayama | 123/336 |
| 4,896,640 | 1/1990 | Pfalzgraf et al. | 123/361 X |

*Primary Examiner*—Tony M. Argenbright
*Attorney, Agent, or Firm*—Martin A. Farber

[57] ABSTRACT

A load-shifting device has a control element (4a, 4b) which acts on a setting member (7, 9) which determines the output of an internal combustion engine. The control element is adapted to be connected to an accelerator (1) and is controllable by an electric setting drive (10) which cooperates with an electronic controller (12). The load-shifting device provides that the setting member includes a main setting member (7) with which there is associated a first control-element part 4a which is coupled with the accelerator. The setting member further includes an auxiliary setting member (9) with which there is associated a second control-element part (4b). The setting path of the first control-element part is limited in idling direction by an idle stop (LL). The second control-element part can, upon application of the first control-eleemnt part against the idling stop, be moved within its idling control range relative to the first control-element part by the electric setting drive. The load-shifting device makes it possible, with simple structural development, to control the internal combustion engine over its entire load range and, in particular by the electric setting drive, over its idling range.

7 Claims, 2 Drawing Sheets

LOAD-SHIFTING DEVICE

FIELD AND BACKGROUND OF THE INVENTION

The present invention relates to a load-shifting device for an automotive vehicle. The device has a control element which acts on a setting member which determines the output of an internal combustion engine. The control element is adapted to be connected to an accelerator, and is controllable also by an electric setting drive which cooperates with an electronic controller.

Load-shifting devices, for instance load-shifting devices cooperating with carburetors or injection pumps, must assure optimum control of the internal combustion engine over the entire load range. This requires a complicated construction or complicated control of the load-shifting device in question. Thus carburetors, for example, have, in addition to the actual device for the forming of the mixture, additional devices such as thinning, starting, idling, accelerating, economizing devices etc. These devices complicate the construction of the carburetor and result in increased expense for parts since additional injection nozzles, pumps, special developments of the nozzle needles and separate air feeds are required, entirely aside from the stringent control requirements inherent in this.

Of particular importance in the case of load-shifting devices is control of the condition of the load upon idling, during which only a minimal output is delivered by the internal combustion engine but during which there may be present, particularly in the case of automobiles, load-consuming devices which require a high output, such as ventilators, rear window heating, air conditioning systems, etc. In order to take these potential demands on the output into account, the control of the load-shifting device between maximum and minimum idling positions is required and, upon failure of the control, an emergency idling position of the setting member or of the control element is to be assured.

Differing from the problem described above, load-shifting devices of the aforementioned type are, as a rule, used in cases where the accelerator and the setting member are electronically connected to each other. The accelerator is coupled to a driver and the latter is connected to the control element. Furthermore, a desired-value detection element associated with the driver and an actual-value detection element cooperating with the desired-value detection element and acting on the electric setting drive are provided. The electric setting drive is adapted to be controlled by the electronic controller as a function of the values detected. The electrical connections of accelerator and setting member to the interposed electronic controller make it possible to compare desired-value positions, determined by the accelerator and the driver coupled to it, with the actual-values indicated by the position of the control element and of the setting member and to check them for the presence or absence of plausibility conditions. Thus, in the event of the presence or absence of given plausibility conditions, there is the possibility of exerting a correcting action. The correcting action is accomplished by the electronic controller by controlling an electric setting drive, on the setting member. The setting drive, for instance, may be developed as a throttle valve or injection pump. An action by the electronic controller, in order to avoid wheel slippage upon starting, due to excessive output determined by the accelerator can be provided, and other automatic interventions into the load-shifting device are, for instance, conceivable in automatic shifting processes of a transmission or a speed-limiting control.

SUMMARY OF THE INVENTION

It is an object of the present invention to create a load-shifting device of the aforementioned type which, while of simple construction, permits control of the internal combustion engine over its entire load range and, in particular, its idling range.

According to the invention, the setting member (7, 9) comprises a main setting member (7) operative with a first control-element part (4*a*) which is coupled to the accelerator pedal of the vehicle. The setting member further comprises an auxiliary setting member (9) operative with a second control-element part (4*b*). The setting path of the first control-element part (4*a*) is limited in idling direction by an idling stop (LL). Upon application of the first control-element part (4*a*) against the idling stop (LL), the second control-element part (4*b*) can be moved within its idling control range relative to the first control-element part (4*a*) by means of the electric setting drive (10).

Due to the inventive development of the load-shifting device, an electronic idling control takes place exclusively by means of the auxiliary setting member with which the second control-element part is associated. The second control-element part is acted on directly by the electric setting drive which, in its turn, is controlled by the electronic controller. During the control of the idling by the auxiliary setting member, the main setting member remains in its idling position since the first control-element part associated with it rests against the idling stop. The activating of the second control-element part which cooperates with the auxiliary setting member is advisedly dependent on plausibility conditions, and the electric setting, drive is therefore not to be activated by the electronic controller until a contact circuit which cooperates with the electronic controller detects the application of the first control-element part against the idling stop associated with it.

It is to be possible to enter into the electronic controller not only variables related to the plausibility conditions but also idling data of the internal combustion engine, so that the electric setting drive can be controlled directly by the electronic controller. An actual-value detection device (11) is advisedly associated with the second control-element part (4*b*), the detection device also cooperating directly with the electronic controller (12). Regardless of the fact that this device reports the instantaneous position of the second control-element part to the electronic controller, there is the possibility, by means of the latter and together with additional switches which detect the position of the first and second control-element parts, for instance the idling contact associated with the first control-element part, to build up a safety logic for the load-shifting device.

In order to assure that, upon a failure of the control circuit associated with the electronic controller, the load-shifting device nevertheless assumes a defined idling position, it is provided that the second control-element part (4*b*) can be urged by a spring (14) of limited path in the direction towards its maximum idling position into an idling emergency condition ($LL_{Not}$). Depending on the pre-determined limitation of path of the spring, this idling emergency position can be selected within the entire idling range; a relatively high idling position will be preferred in order to assure also the power consumption by large load consuming devices upon a failure of the electronic controller.

Further according to a feature of the invention, a contact (13) is provided for detecting the idling position (LL) of the first control-element part (4*a*) which controls the electric setting drive (10) via the electronic controller.

According to a further embodiment of the invention, the second control-element part (4*b*) can be coupled to a projection (19) via a coupling (18), and a restoring spring (20) urges the projection (19) in the direction of the minimum idling position of the second control-element part 4*b*. The projection (19) comes to rest against a stop (<LL), in the event that the clutch (18) is disengaged and the first control-element part (4*a*) extends on its side facing the stop (LL) into a setting path of the projection (19).

The foregoing feature of the second control-element part with the projection makes it possible, when the projection is coupled and, in case of a movement of the second control-element part beyond the maximum idling position, to act on the first control-element part so as to effect a speed-limitation control. The speed limitation is attained by causing the first control-element part to be applied against the second control-element part in the region of the projection, with the first control-element part controlling the second control-element part between the idling position and the full-load position. This control is independent of any pulse which may be introduced via the accelerator.

With such a speed-limitation control, a connection of the control electronics to the contact which is associated with the first control-element part and which detects the idling position of this control-element part must be assured in such a manner that, upon leaving the idling position of the first control-element part and thus a change in the contacting via the control electronics, the electric setting drive acting on the second control-element part nevertheless remains activated. The same applies by analogy to the coupling in order to couple the projection.

If the speed-limitation control in the partial and/or full-load ranges is deactivated, the restoring spring assures that the projection is pulled against an idle stop, in which case the position of this idle stop should be so selected that the projection is not contacted by the first control-element part when the latter is applied against the idle stop. Upon a deactivation of the speed control, the coupling is also advisedly deactivated, and assurance must furthermore be had that the electric setting drive moves the second control-element part back into an idling position and, in particular, into the idling emergency position.

In order not to have any additional load control take place via the auxiliary setting member upon operation of the speed limitation control, the control of the second control-element part should be so selected with respect to the auxiliary setting member that a change in the position of this control-element part above the idling control range up to the full-load range does not lead to a change in the position of the auxiliary setting member.

In accordance with another embodiment of the invention, the setting member, i.e. both the main setting member and the auxiliary setting member, the control element, i.e. both the first control-element part and the second control-element part, as well as the electric setting drive form a unitary structural unit.

The invention provides as another feature that the setting member (7, 9), the control element (4*a*, 4*b*) and the electric setting drive (10) form a unitary structural unit (22).

BRIEF DESCRIPTION OF THE DRAWING

With the above and other objects and advantages in view, the present invention will become more clearly understood in connection with the detailed description of preferred embodiments, when considered with the accompanying drawing, of which

DETAILED DESCRIPTION OF THE PREFERRED EMBODIMENTS

Figure 1:
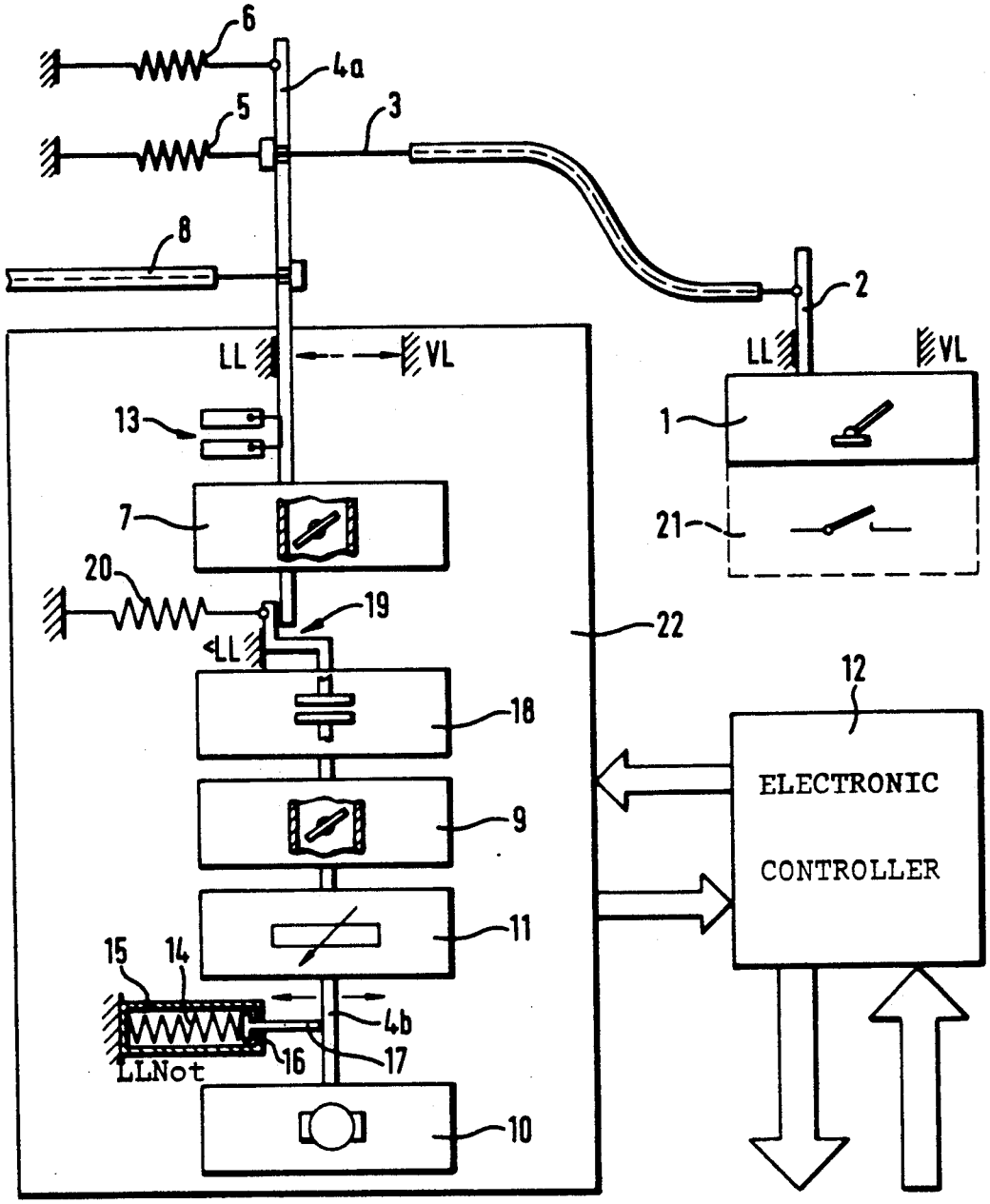
FIG. 1 is a block diagram of the load-shifting device in accordance with the invention, having main and auxiliary setting members developed in each case as throttle valve.

FIG. 1 shows an accelerator 1 by which a lever 2 can be displaced between an idle stop LL and a full-load stop VL. Via a gas cable 3 the lever 2 can displace a first control-element part 4*a* in the direction of another full load stop VL and is urged in idling direction by means of a return spring 5 which acts on the gas cable 3. A return spring 6 which acts on the first switch-element part 4*a* urges the latter in idling direction. When the gas cable 3 is not acted on, the first control-element part 4*a* rests against an idle stop LL associated with it.

The first control-element part 4*a* serves directly to displace a main setting member 7 which is developed as throttle valve and by means of which the internal combustion engine is controlled between idling and full load. If one disregards the speed-limitation control described below, the control of the main setting member 7 takes place mechanically, namely by the gas cable 3 or the automatic cable 8 of an automatic transmission (not shown in detail) by means of which the first switch-element part 4*a* can also be displaced.

The load-shifting device of the invention has, in addition to the main setting member 7, an auxiliary member 9 which is also developed as throttle valve and which is connected to a second control-element part 4*b*. The second control-element part 4*b* and thus the auxiliary setting member 9 can be moved by an electric motor 10. An actual-value detection device 11, which cooperates directly with an electronic controller 12 and indirectly via the latter with the electric motor 10, is associated with the second control-element part 4*b*. In addition to this, the electronic controller 12 detects signals which are given off by an idle contact 13 which is activated whenever the first control-element part 4*a* is applied against the idle stop LL.

Furthermore, external variables of state concerning the internal combustion engine or, in general, concerning the automobile equipped with it, are entered into the controller 12 and retrieved therefrom as well as transferred by the controller 12 to the parts of the load-shifting device controlled by it. The electronic controller 12 thus serves the purpose, together with the actual-value detection device 11 and the idling contact 13 and the external reference variables, of building up a safety logic with respect to the control of the first and second switch- element parts 4a and 4b.

When the lever 2, which cooperates with the accelerator 1, is in its idling position LL and the first control-element part 4a is thus also at the idle stop LL, the contacting of the idle contact 13 takes place and, upon the presence of plausibility conditions, the electric motor 10 is then activated via the electronic controller 12, the electric motor controlling the auxiliary setting member 9, as desired by the control electronics 12, in the idling range between a minimum and maximum idling position. Plausibility conditions are in this case verified inter alia by means of the actual-value detection device 11, which can display the entire load range of the internal combustion engine.

If the electronic controller 12 or the electric motor 10 does not function properly at an idling position of the second control-element part 4b which is less than the idling emergency position $LL_{Not}$, then a spring 14 of limited path which is pre-tensioned in the direction of the maximum idling position brings about the transfer of the second control-element part 4b into the idling emergency position. The limitation of the path of the spring 14 can, for instance, be effected by a ram 17 which is displaceable in a stationary sleeve 15 against a stop 16 and is acted on by the spring 14. When the second control-element part 4b is moved in the direction of the minimum idling position by the electric motor 10, the ram 17 is pushed into the sleeve 15 by the second control-element part 4b and, in this case, prestresses the spring 14 further.

In order to carry out with the load-shifting device of the invention, a speed-limitation control which is effected by means of the electronic controller 12 and the electric motor 10, the second control-element part 4b can be coupled via a clutch or coupling 18 to a projection 19. The first control-element part 4a extends on its side facing the idling stop LL into the setting path of the projection 19. If projection 19 and second control-element part 4b are coupled to each other, a movement of the second control-element part 4b in the direction of full load leads to the application of the projection 19 against the first control-element part 4a, which can then be moved by the electric motor 10 into any desired load position between the idle stop and the full-load stop. A return spring 20 urges the projection 19 in the direction of the minimum idling position of the second control-element part 4b, whereby the projection 19 comes to rest against a stop <LL when the coupling 18 is open; in this position a gap remains between this control-element part 4a and the projection 19 even if the first control-element part 4a rests against the idle stop LL. The gap is not bridged over until, with the coupling 18 closed, the second control-element part 4b has assumed a position which is outside the idling range and thus above the maximum idling position of the second control-element part 4b.

After a speed-limitation control upon which the first control-element part 4a is located between the stops LL and VL, the coupling 18 is advisedly first of all opened so that the return spring 20 can pull the projection 19 against the stop associated with the latter, and assurance should then be had by means of the electronic controller 12 that the electric motor 10 moves the second control-element part 4b into the position $LL_{Not}$.

In the event that the first control-element part 4a cannot be displaced in the idling direction after releasing the accelerator 1, a pedal contact switch 21 is provided on the accelerator 1, which can detect such a failure.

Figure 2:
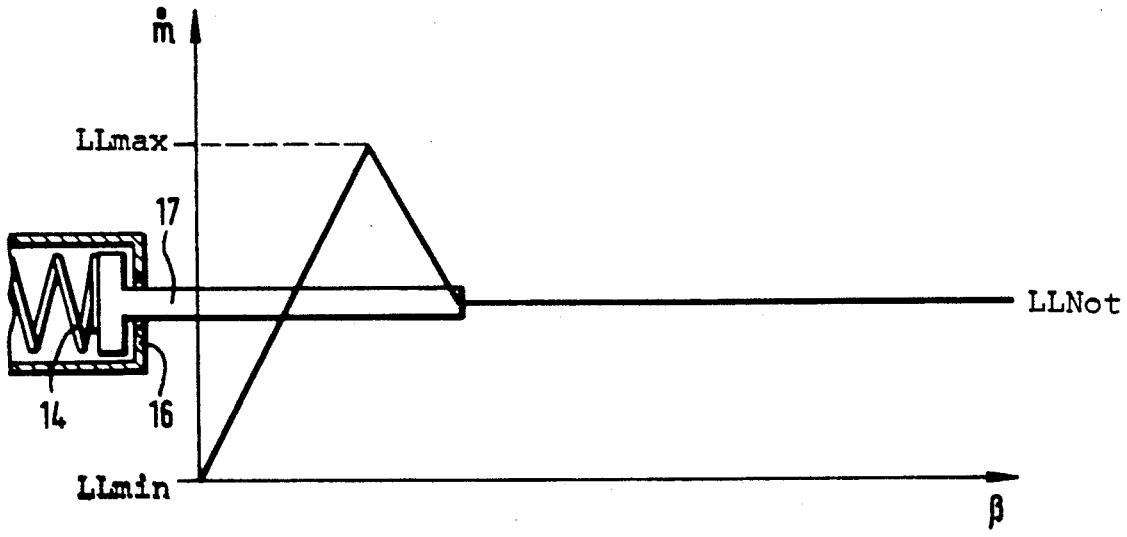
FIG. 2 is a diagram to illustrate the air throughput m permitted by the auxiliary setting member as a function of the throttle-valve and angle 8 of the auxiliary setting member.

With respect to the auxiliary setting member 9, which is developed as throttle valve, FIG. 2 illustrates the air throughput m released by the setting member as a function of the throttle valve angle $\beta$. Upon control of the throttle valve by the electric motor 10, the air throughput m is increased upon travel through the idling control range between the throttle-valve position $LL_{min}$ and the throttle-valve position $LL_{max}$ by an increasing throttle valve opening angle $\beta$. Upon a failure of the electric motor 10, the ram 17, which is acted on by the spring 14, pushes the throttle valve up to the limitation of the path of the ram by the projection 16 via the second control-element part 4b into a valve position having a throttle-valve angle $\beta$ which is increased relative to the position $LL_{max}$ and has an air throughput which is reduced relative to the maximum air throughput. From this position of the throttle valve on, any further swinging of the throttle valve does not lead to a change in the air throughput, whereby the speed control function is assured.

The frame 22 of FIG. 1 illustrates that the parts enclosed by it form a structural unit. The essential features of this structural unit are the main setting member 7, the auxiliary setting member 9, the first control-element part 4a, the second control-element part 4b and the electric motor 10.

We claim:

1. A load-shifting device for an internal combustion engine comprising;

a setting member, an electric setting drive, and an electronic controller;

a control element for driving the setting member to establish an output of the internal combustion engine, there being a accelerator for applying fuel to the engine; and wherein the control element is connected to the accelerator and is controllable by the electric setting drive in cooperation with the electronic controller;

said setting member includes a main setting member and an auxiliary setting member;

said control element includes a first control element part and a second control element part;

said first control-element, part is coupled to said accelerator and to said main setting member;

said second control-element part is coupled to said auxiliary setting member;

said device further comprises an idling stop, and a setting path of said first control-element part is limited in idling direction by said idling stop; and upon application of said first control-element part against said idling stop, said second control-element part is moved within an idling control range thereof relative to said first control-element part by means of said electric setting drive.

2. A load-shifting device according to claim 1, further comprising a spring of limited path of motion; and wherein said second control-element part is driveable by said spring in a direction towards maximum idling position to reach an idling emergency setting.

3. A load-shifting device according to claim 2, further comprising a contact for detecting the idling position of said first control-element part, said first control-element part controlling said electric setting drive via said electronic controller.

4. A load-shifting device according to claim 1, further comprising a contact for detecting the idling position of said first control-element part, said first control-element part controlling said electric setting drive via said electronic controller.

5. A load-shifting device according to claim 1, further comprising an actual-value detection device connected with said second control-element part, the detection device cooperating with the electronic controller.

6. A load-shifting device according to claim 1, further comprising a projection, a coupling, a restoring spring, and a second stop; and wherein said second control-element part is coupled to said projection via said coupling;

said restoring spring urges the projection in the direction of the minimum idling position of the second control-element part, said projection coming to rest against said second stop in the event that said coupling is disengaged; and said first control-element part extends on its side facing said first-mentioned stop into the setting path of said projection.

7. A load-shifting device according to claim 1, wherein said setting member, said control element, and said electric setting drive form a unitary structural unit.

* * * * *